US005934136A

United States Patent [19]

Bracher et al.

[11] Patent Number: 5,934,136

[45] Date of Patent: Aug. 10, 1999

[54] COMPRESSION HEAD FOR A HYDRAULIC COMPRESSION TOOL

[75] Inventors: L'orient Bracher, Germiston, South Africa; Masafumi Yamamoto, Matsumoto, Japan

[73] Assignee: Izumi Products Company, Nagano, Japan

[21] Appl. No.: 09/035,830

[22] Filed: Mar. 6, 1998

[51] Int. Cl.[6] ..... H01R 43/042

[52] U.S. Cl. ..... 72/397; 72/402; 72/409.1; 29/751

[58] Field of Search ..... 72/402, 397, 396, 72/409.14, 409.1, 452.9; 29/753, 751

[56] References Cited

U.S. PATENT DOCUMENTS

| | | | |
|---|---|---|---|
| 3,154,981 | 11/1964 | McDurmont | 72/402 |
| 3,706,219 | 12/1972 | Hoffman | 72/402 |
| 5,007,280 | 4/1991 | Quinn | 72/402 |

FOREIGN PATENT DOCUMENTS

| | | | |
|---|---|---|---|
| 273230 | 12/1986 | Japan | 72/402 |
| 402479 | 10/1973 | U.S.S.R. | 72/402 |

*Primary Examiner*—Daniel C. Crane

*Attorney, Agent, or Firm*—Liniak, Berenato, Longacre & White

[57] ABSTRACT

A compression head for a hydraulic compression tool comprises a fixed die and movable dies, the fixed die being mounted on a stationary head attached to a tool body and the movable dies being positioned within the stationary head and actuated by a piston of a pump mechanism equipped in the tool body. The piston is attached at its front end to a guide plate having a center support and two side supports. The guide plate is provided at both front and reverse sides with guide grooves. Each of the movable dies rests on the upper surface of each side support through a roller means, while it is interposed between two guide plates slidably engaging with said guide grooves of each side support. Further, each of the movable dies is supported against the center support by a return spring, which is received at one end by an insertion hole of each movable die and at the other end by a cutout on the center support.

2 Claims, 7 Drawing Sheets

COMPRESSION HEAD FOR A HYDRAULIC COMPRESSION TOOL

BACKGROUND OF THE INVENTION

1. Field of the Invention

The present invention relates to a hydraulic compression tool of the type used for connecting electric wires or cables by compressing a connector or sleeve attached between and holding therein two wires, and more particularly to a compression head thereof having improved design.

2. Prior Art

Upon installation of electric wires or cables, a hydraulic compression tool is used for compressing a sleeve attached between and holding therein two cables. Such hydraulic compression tool has a compression head for pressing and deforming the sleeve. The sleeve of this type is generally tubular or C-shape in its cross section.

A conventional compression head is shown in FIG. 5. The compression head 50 comprises a generally Y-shaped stationary head 51, and a guide plate 52 reciprocally movable within the stationary head 51. Movable dies 53, 54 are slidably mounted on the guide plate 52.

The stationary head 51 is attached at its base portion 51*a* to an electrically or manually operated tool body (not shown) and the end portion 51*b* thereof is provided with a die 71. The head 51 is attached for limited rotational movement with respect to the non-shown tool body.

The guide plate 52 is attached to a piston 55 of the tool body (not shown) and when the tool is actuated by its motor pump or by swinging its manipulating handle, hydraulic fluid is flown into a cylinder 56, applying pressure on the piston within the cylinder 56 and hence the guide plate 52 attached thereto.

The guide plate 52 includes a stem or center support 57 extending from the center of the plate 52 and side supports 58, 59 extending at a predetermined angle at both sides of the center support 57. The center support 57 is provided at its top end with a die 72 and at its base portion with two screw holes 57*a*, 57*b* for receiving two guide pins 60 and 61, respectively. One end of each guide pin 60, 61 is screwed into the screw hole 57*a*, 57*b* and the other end is loosely inserted through a return spring 62, 63 into the movable die 53, 54.

Each movable die 53, 54 is provided at the inward surface 53*a*, 54*a* with a die 73, 74 and at the bottom surface 53*b*, 54*b* with a plurality of rollers 64, 65 so as to be sidable on the top surface 58*a*, 59*a* of the side support 58, 59. Provided at the end of each side support 58, 59 is a stopper 66, 67 preventing the rollers from coming off.

Upon installation, a sleeve 46 is set to rest in the central area of the compression head 50 surrounded by the aforesaid dies 71, 72, 73, 74 and then electric wires or cables 47 to be connected are inserted in the sleeve 46. When the piston 55 is moved forward, the four dies 71, 72, 73 and 74 press the sleeve 46, thus compressing and deforming the sleeve to connect the wires. The deformed sleeve 46 is shown in FIG. 6.

However, in the conventional compression head 50, the center support 57 is subjected to an undue load when the sleeve 46 is improperly set. This is shown in FIG. 7. Since the center support 57 is originally weak in its strength because of the two screw holes 57*a*, 57*b* for receiving the guide pins 60, 61, it is often broken by the applied pressure upon compressing.

SUMMARY OF THE INVENTION

In view of the foregoing disadvantage, the object of the invention is to provide a compression head for a hydraulic compression tool having improved design at which movable dies are mounted and thus increasing the mechanical strength of its guide plate.

According to the present invention, there is provided a compression head for a hydraulic compression tool comprising: a fixed die provided on a stationary head attached to a tool body; and movable dies positioned within the stationary head and actuated by a piston of a pump mechanism equipped in the tool body characterized in that: said piston is attached at its front end to a guide plate having a center support and two side supports, said side supports being provided with guide grooves; each of said movable dies rests on the upper surface of each side support through a roller means, while it is interposed between two guide plates slidably engaging with said guide grooves of each side support; and each of said movable dies is supported against said center support by a return spring, which is received at one end by an insertion hole of each movable die and at the other end by a cutout on the center support.

It is also a feature of the present invention to provide a compression head for a hydraulic compression tool wherein a die is provided at the top end of the center support.

Other features and advantages of the present invention will become apparent from the following detailed description taken in conjunction with the accompanying drawings.

DETAILED DESCRIPTION OF THE PREFERRED EMBODIMENT

Figure 1:
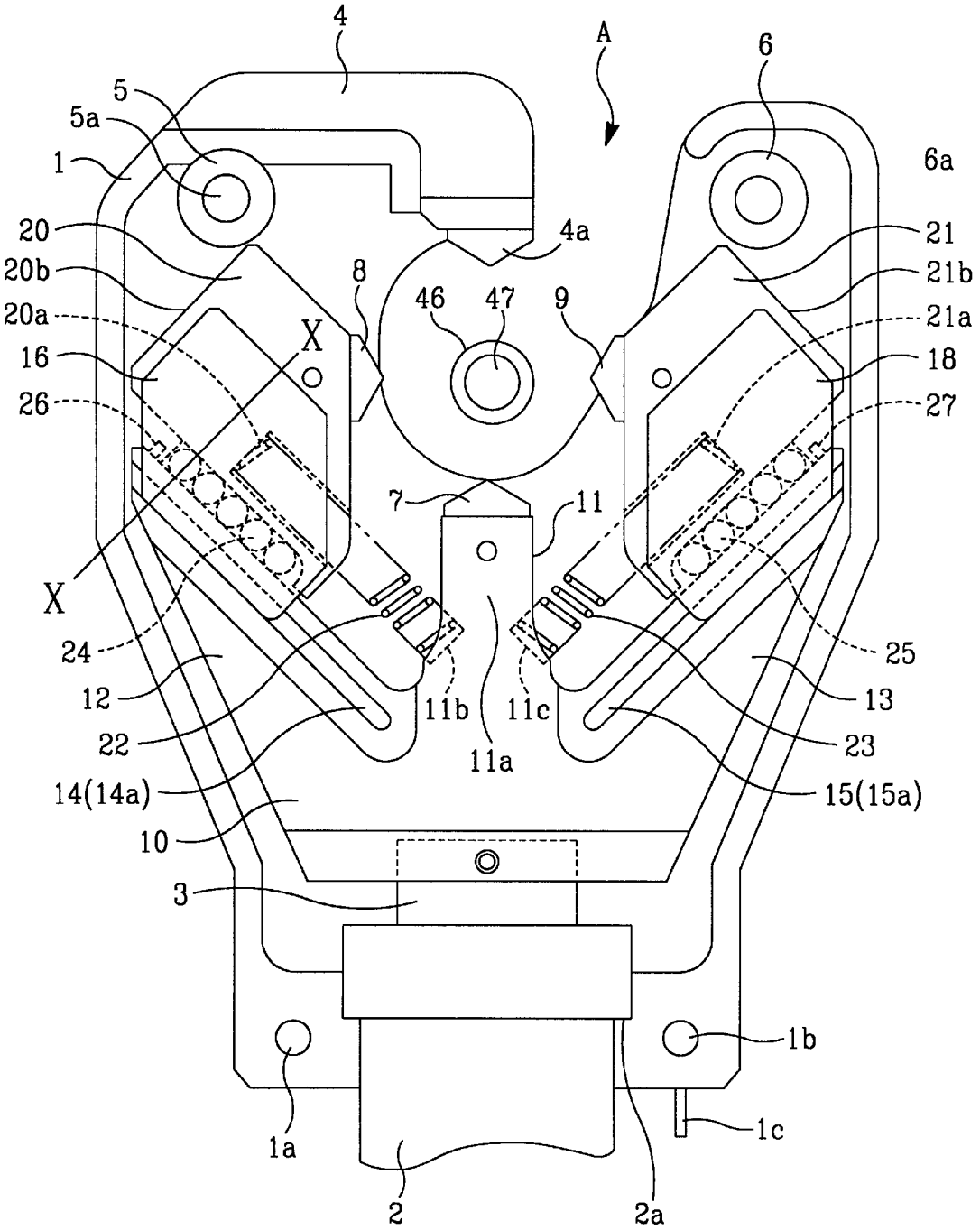
FIG. 1 is a front view showing a compression head for a hydraulic compression tool according to the present invention.

Referring to FIG. 1, there is shown a compression head A for a hydraulic compression tool comprising a generally Y-shaped stationary head 1, and a guide plate 10 positioned within the stationary head 1. The guide plate 10 is connected to a piston 3 of a cylinder 2 equipped in a tool body 30. The guide plate 10 is thus operated by the piston 3 as hereinafter described.

The Y-shaped stationary head 1 is provided at one front end with a fixed die 4, the front end 4*a* of which is bent toward the center of the compression head A. The base portion of the stationary head 1 is provided with two attachment holes 1*a*, 1*b*. The cylinder 2 of the tool body 30 is received at its stepped portion 2*a* between the base portions of the stationary head 1 and another symmetrical stationary head (not shown) so as to permit a relative rotational movement. The two stationary heads are connected by inserting bolts through the attachment holes 1*a*, 1*b*. The stationary head 1 is also provided at the base portion with a stopper pin 1*c*, which engages with a stopper pin 37*b* (FIG. 3) for limited rotational movement.

Rollers 5, 6 are attached to the vicinity of the front end of the stationary head 1 with their axes 5*a*, 6*a* extending across the symmetrical stationary head and fixed by clasps (not shown) from the outer ends thereof Within the stationary head 1, the guide plate 10 is positioned. The guide plate 10 includes a stem or center support 11 protruding from the base portion 11*a* and two side supports 12, 13 extending at a predetermined angle at both sides of the center support 11.

The center support 11 is provided at its top end with a die 7 and at its base portion 11*a* with two shallow cutouts 11*b*, 11*c* for the engagement with return springs 22, 23, respectively.

As shown in FIG. 1, guide grooves 14*a*, 14*b* or 15*a*, 15*b* are formed longitudinally along each side support 12, 13 at both front and reverse sides. Two slide plates 16, 17 or 18, 19 are slidably mounted on each side support 12, 13 with each lower part guided in the corresponding guide groove.

Figure 2:
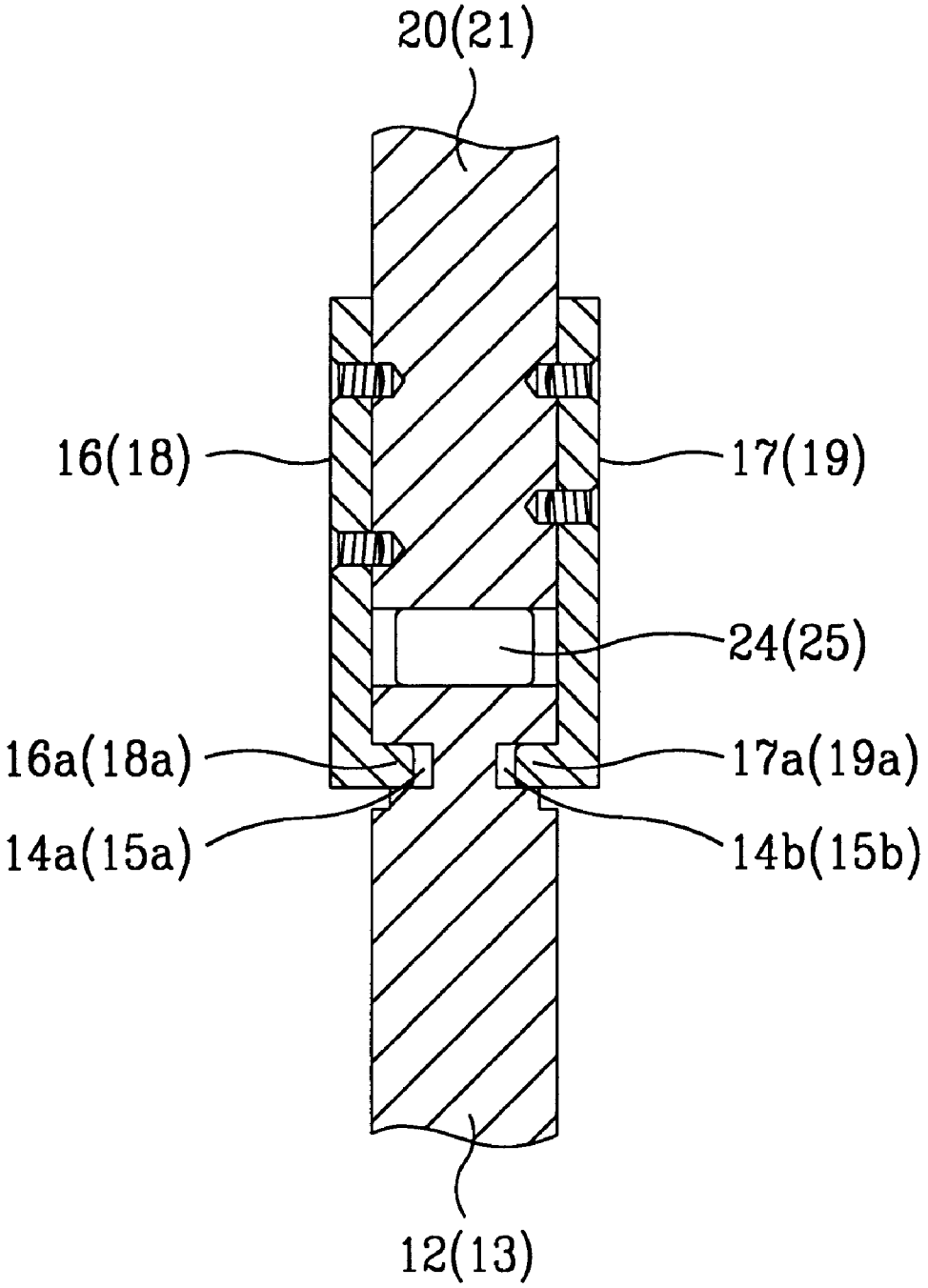
FIG. 2 is a sectional view taken along the line X—X of FIG. 1.

As shown in FIG. 2, each pair of slide plates 16, 17 or 18, 19 are slidably engaging at a respective guide portion 16*a*, 17*a* or 18*a*, 19*a* with the corresponding guide grooves 14*a*, 14*b* or 15*a*, 15*b*. Interposed between these slide plates 16, 17 or 18, 19 is a movable die 20, 21, which is fixed to the slide plates by screws.

A plurality of rollers 24, 25 are provided between the movable die 20, 21 and the side support 12, 13 so as to permit a smooth sliding movement of the movable die on the respective side support.

Each movable die 20, 21 is provided at its center with an insertion hole 20*a*, 21*a* for receiving a return spring 22, 23. One end of each return spring 22, 23 is inserted into the insertion hole 20*a*, 21*a* and the other end is supported on the cutout 11*b*, 11*c* formed on the base portion 11*a* of the center support 11. Therefore, movable dies 20, 21 are urged outwardly by the return springs 22, 23.

Since a plurality of rollers 24, 25 are also urged outwardly together with the movable die 20, 21 by the action of the return spring 22, 23, a stopper pin 26, 27 is provided at the corresponding end of the upper surface of each side support 12, 13 so as to prevent the rollers 24, 25 from coming off.

Figure 3:
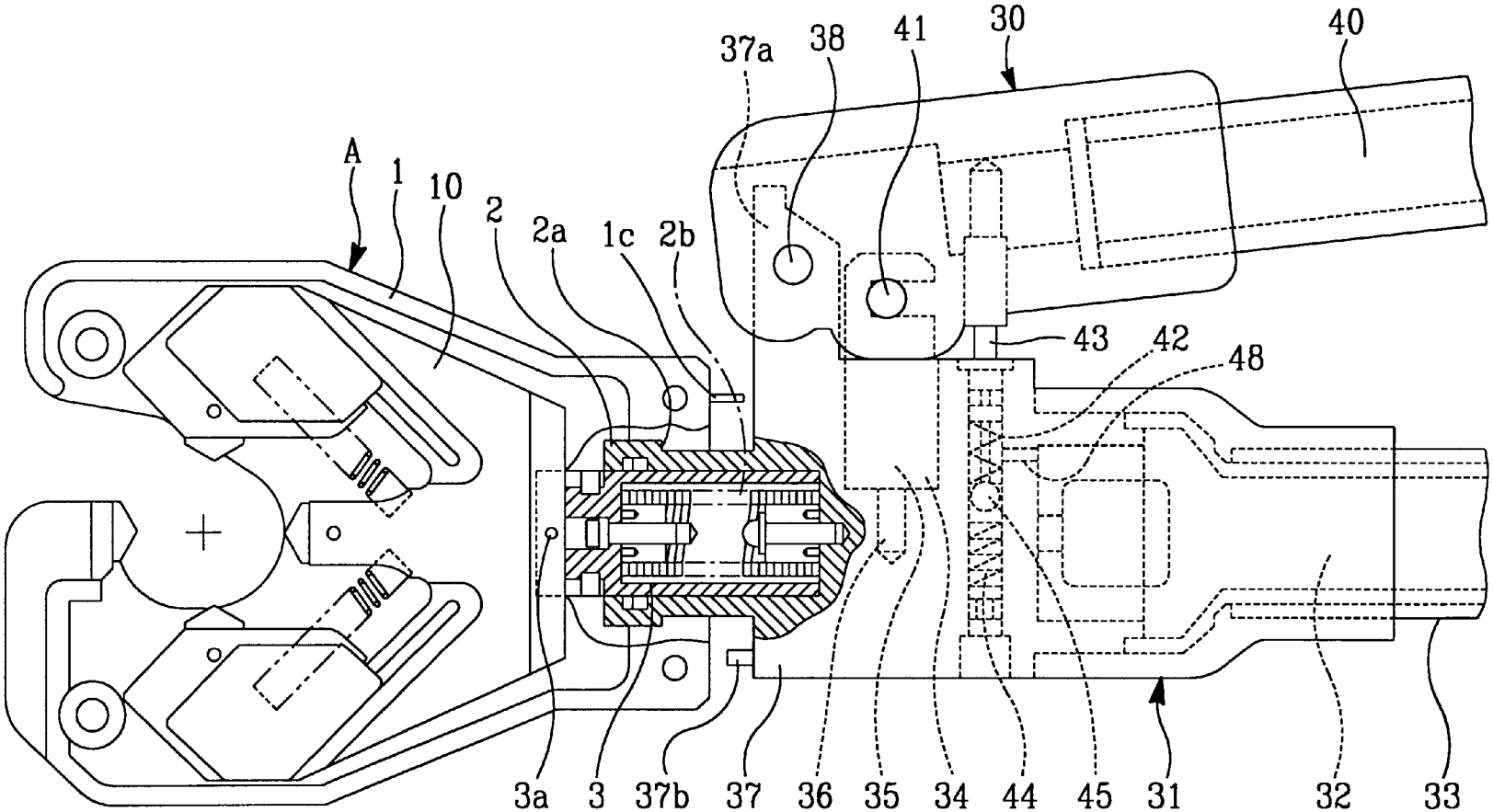
FIG. 3 is a side view showing the compression head attached to the tool body.

As shown in FIG. 3, the compression head A of the hydraulic compression tool is attached for limited rotational movement with respect to the tool body 30.

The tool body 30 includes a fixed handle 33 and a movable handle 40. The movable handle 40 is pivotably connected to the upper post 37*a* of the fixed handle 33 by a pivot axis 38. An oil reservoir 32 is accommodated within the space provided at the base portion 31 of the fixed handle 33. Also accommodated at the upper part of the fixed handle 33 is a plunger 34, which upper portion is engaged with an engaging axis 41 of the movable handle 40. The plunger 34 is thus reciprocally movable at both upward and downward directions by swinging the movable handle 40 around the pivot axis 41, and which provides a pump mechanism.

Further, a fluid-return mechanism is arranged in parallel relation to the plunger 34 for returning hydraulic fluid within the hydraulic circuit (not shown) to the oil reservoir 32. When the movable handle 40 is rotated and then swung down, the upwardly urged release pin 43 under the action of a spring 42 is depressed, opening a spring-biased return valve 45 and hence communicating the hydraulic circuit with the oil reservoir 32.

The tool body 30 is provided at the front end of its trunk 37 with a cylinder 2, in which is fitted a piston 3 urged toward the tool body 30 by a return spring 2*b*. The front end of the piston 3 is connected to the guide plate 10 by way of a guide pin 3*a*.

The tool body 30 is further provided at its front end with a stopper pin 37*b* which engages with the corresponding stopper pin 1*c* of the stationary head 1 for limited rotational movement of the compression head A.

The operation of the compression head A attached to the tool body 30 will be described below.

Referring to FIG. 3, when the movable handle 40 is swung up and down while the fixed handle 33 is stationarily hold, hydraulic fluid is flown from the oil reservoir 32 via the hydraulic circuit (not shown) to the cylinder 2, displacing the piston 3 in the forward direction.

The guide plate 10 attached to the front end of the piston 3 is guided within the stationary head 1 and is thus moved forward toward the center of the stationary head 1 by the forward movement of the piston 3.

Figure 4:
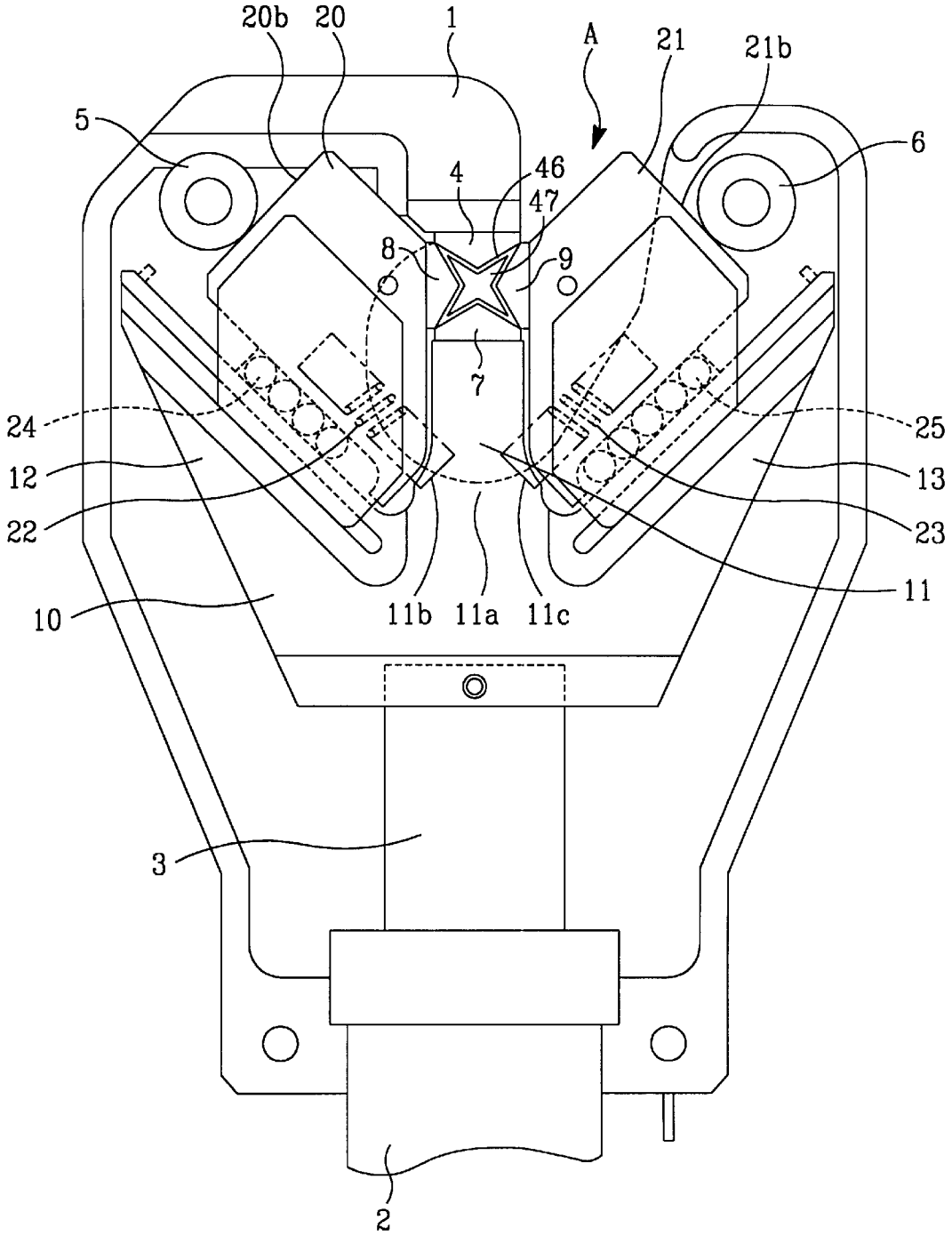
FIG. 4 is a front view showing a sleeve compressed and deformed by the compression head of FIG. 1.
Figure 5:
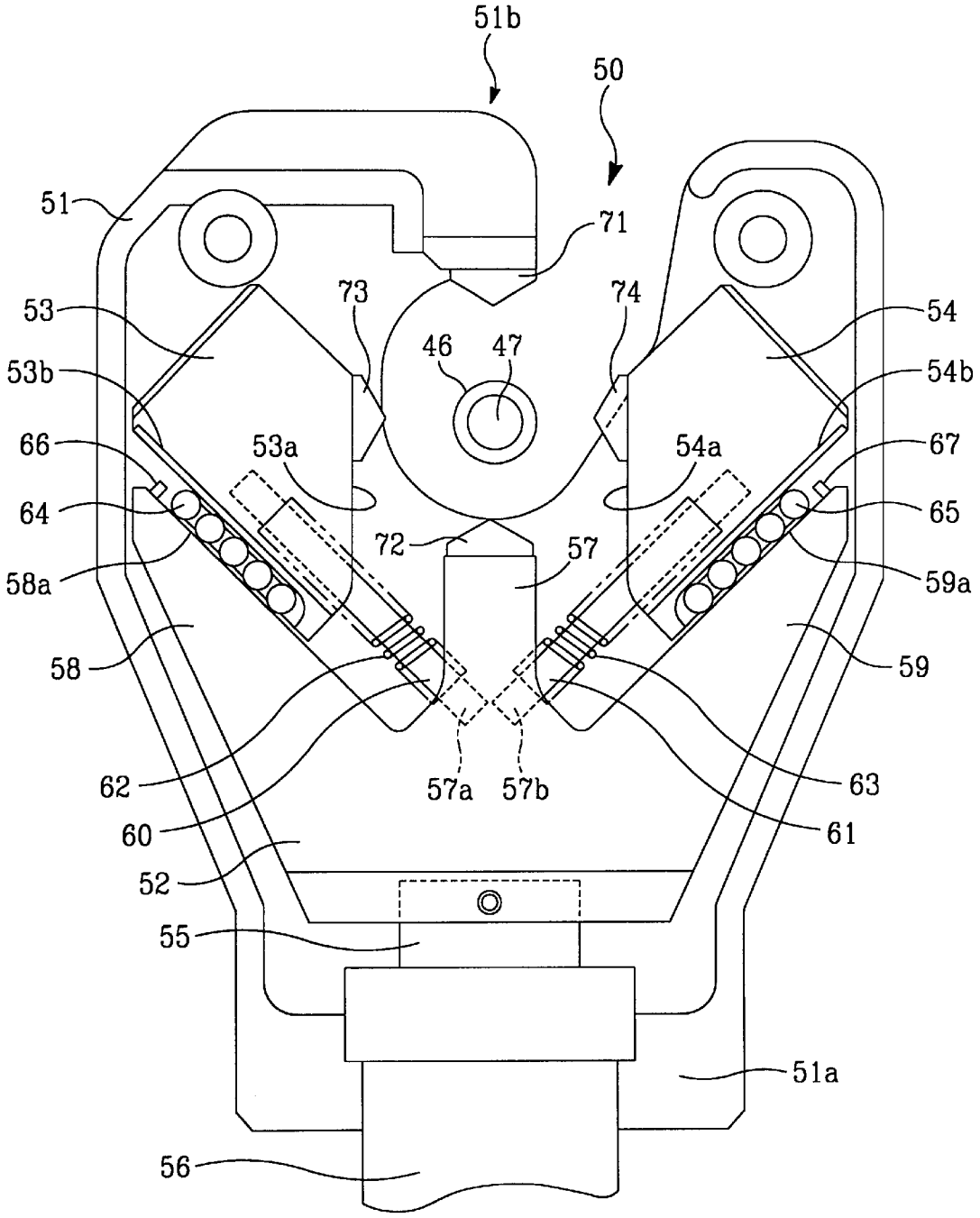
Fig. 5 Prior Art
FIG. 5 is a front view showing a conventional compression head for a hydraulic compression tool.
Figure 6:
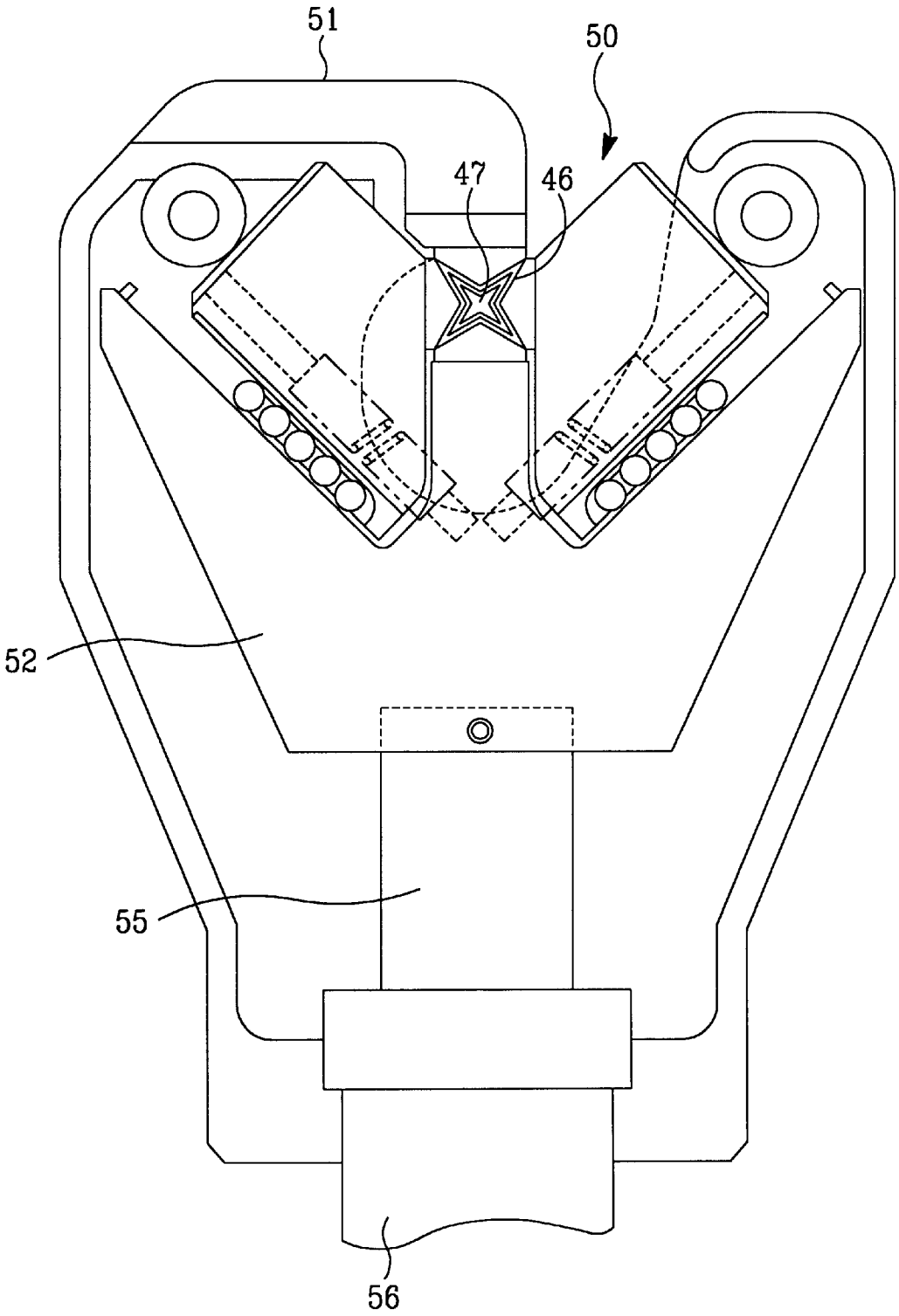
Fig. 6 Prior Art
FIG. 6 is a front view showing a sleeve compressed and deformed by the conventional compression head.
Figure 7:
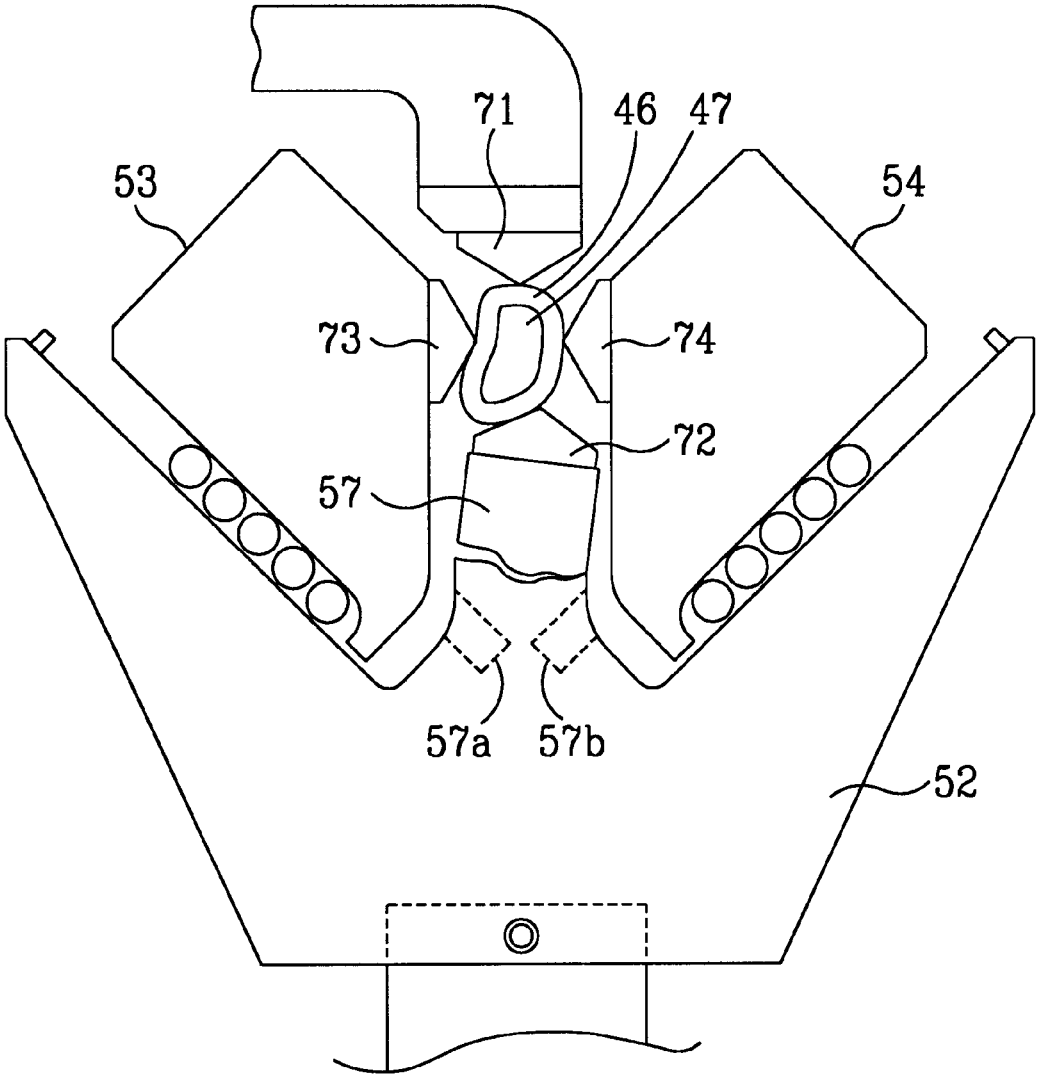
Fig. 7 Prior Art
FIG. 7 is a view explaining a disadvantage caused by the conventional compression head.

As shown in FIG. 4, when the guide plate 10 is moved forward, the movable dies 20, 21 are together moved (upward in the figure). By the advance movement of the piston 3, the movable dies 20, 21 abut against the rollers 5, 6 of the stationary head 1 at the respective front surfaces 20*b*, 21*b* thereof, displacing the dies 20, 21 toward the center so as to press and deform the sleeve 46 which is rest in the central area surrounded by the dies of the compression head A. During the compressing movement of the sleeve 46, hydraulic pressure within the cylinder 2 gradually raises.

When hydraulic pressure within the plunger chamber 35 for the plunger 34 raises to a certain level, a great amount of hydraulic fluid is flown from the plunger chamber 35 of larger diameter, opening a low pressure control valve (not shown), back to the oil reservoir 32.

By the advance movement of the piston 3, the guide plate 10 is moved forward and the movable dies 20, 21 abut against the rollers 5, 6 at the front surfaces 20*b*, 21*b* thereof, and the movable dies 20, 21 together with the rollers 5, 6 are slidably shifted against the spring action of the return springs 22, 23 in diagonal downward directions along the guide grooves 14, 15 provided at both sides of the respective side supports 12, 13. The dies 8, 9 provided on the inward surfaces of the respective movable dies 20, 21 are thus displaced toward the center, compressing and deforming the sleeve 46 to be connected with other dies 4 and 7 provided on the stationary head 1 and the guide plate 10, respectively.

When the compressing operation is advanced and hydraulic pressure within the cylinder 2 raises to a certain level, hydraulic fluid is flown via a high pressure oil passage (not shown), a high pressure control valve and a return oil passage 48, then back to the oil reservoir 32.

Upon completion of the compressing operation, the movable handle 40 is rotated and swung down, thereby depressing a release pin 43 of a return valve mechanism so as to open the return valve 45. Hydraulic fluid within the cylinder 2 is therefore flown via the high pressure oil passage and the return valve 45 back to the oil reservoir 32. During this flowing back operation, the volume of hydraulic fluid within the cylinder 2 is reduced and the piston 3 within the cylinder 2 is forced back to its original position by the spring 2*b*. The guide plate 10 attached to the piston 3 is thus moved back to its original position, and hence the movable dies 20, 21 slidably mounted thereto under the resilient action of the springs 22, 23 as they are released from the abutting engagement with the rollers 20, 21.

In the compression head of the present invention, the center support 11 is provided with shallow cutouts in stead of conventional relatively deep screw holes. Such arrangement of the shallow cutouts contributes to sufficient strength of the support 11, and thus prevents the center support 11 from being broken even if the center support 11 is subjected to an undue load due to improper positioning of a sleeve during repeated compressing operations.

The compression head of the present invention has been described as being attached to a manually operated hydraulic compression tool. However, it should be recognized that the compression head of the invention is also compatible with other types of compression tools, such as motor pump operated-type and the like.

What is claimed is:

1. A compression head for a hydraulic compression tool comprising:

a fixed die provided on a stationary head attached to a tool body; and movable dies positioned within the stationary head and actuated by a piston of a pump mechanism equipped in the tool body characterized in that:

said piston is attached at its front end to a guide plate having a center support and two side supports, said side supports being provided with guide grooves;

each of said movable dies rests on the upper surface of each side support through a roller means, while it is interposed between two guide plates slidably engaging with said guide grooves of each side support; and each of said movable dies is supported against said center support by a return spring, which is received at one end by an insertion hole of each movable die and at the other end by a cutout on the center support.

2. A compression head according to claim 1, wherein a die is provided at the top end of said center support.

* * * * *